US012011035B2

(12) United States Patent
Jang et al.

(10) Patent No.: US 12,011,035 B2
(45) Date of Patent: Jun. 18, 2024

(54) APPARATUS FOR GENERATING AEROSOLS COMPRISING HEATER FOR HEATING MATERIALS HAVING DIFFERENT PHASES FROM EACH OTHER

(71) Applicant: KT&G CORPORATION, Daejeon (KR)

(72) Inventors: Yong Joon Jang, Daejeon (KR); Gyoung Min Ko, Daejeon (KR); Jang Won Seo, Daejeon (KR); Min Seok Jeong, Seoul (KR); Jin Chul Jung, Seoul (KR); Chul Ho Jang, Bucheon-si (KR); Jong Seong Jeong, Suwon-si (KR)

(73) Assignee: KT&G CORPORATION, Daejeon (KR)

( * ) Notice: Subject to any disclaimer, the term of this patent is extended or adjusted under 35 U.S.C. 154(b) by 713 days.

(21) Appl. No.: 17/260,448

(22) PCT Filed: Sep. 17, 2019

(86) PCT No.: PCT/KR2019/011950
§ 371 (c)(1),
(2) Date: Jan. 14, 2021

(87) PCT Pub. No.: WO2020/060129
PCT Pub. Date: Mar. 26, 2020

(65) Prior Publication Data

US 2021/0289839 A1 Sep. 23, 2021

(30) Foreign Application Priority Data

Sep. 18, 2018 (KR) ..... 10-2018-0111605

(51) Int. Cl.
*A24F 40/30* (2020.01)
*A24F 40/20* (2020.01)
(Continued)

(52) U.S. Cl.
CPC ..... *A24F 40/30* (2020.01); *A24F 40/20* (2020.01); *A24F 40/42* (2020.01); *A24F 40/46* (2020.01); *A24F 40/48* (2020.01)

(58) Field of Classification Search
CPC ..... A24F 40/30; A24F 40/20; A24F 40/42; A24F 40/46; A24F 40/48; A24F 40/10;
(Continued)

(56) References Cited

U.S. PATENT DOCUMENTS 9,844,234 B2 12/2017 Thorens et al.
10,165,797 B2 * 1/2019 Chen ..... A24F 40/46
(Continued)

FOREIGN PATENT DOCUMENTS

CN 105795527 A 7/2016
CN 107438371 A 12/2017
(Continued)

OTHER PUBLICATIONS

Extended European Search Report dated Nov. 5, 2021, issued by the European Patent Office in application No. 19861615.3.
(Continued)

*Primary Examiner* — Alexander Gilman
(74) *Attorney, Agent, or Firm* — Sughrue Mion, PLLC

(57) ABSTRACT

Provided is an aerosol generating device comprising: a heater for heating a first material a solid phase and a second material in a liquid phase; and a controller for controlling power supplied to the heater, wherein as the heater is powered, a first aerosol generated from the first material and a second aerosol generated from the second material are released.

14 Claims, 8 Drawing Sheets

(51) Int. Cl.
*A24F 40/42* (2020.01)
*A24F 40/46* (2020.01)
*A24F 40/48* (2020.01)

(58) Field of Classification Search
CPC ..... A24F 40/50; A24F 40/44; A24F 40/485; A24D 1/20; H05B 1/02; H05B 3/10; H05B 2203/03
USPC ..... 131/329
See application file for complete search history.

(56) References Cited

U.S. PATENT DOCUMENTS

| | | | | |
|---|---|---|---|---|
| 10,492,527 | B2 | 12/2019 | Liu et al. | |
| 11,090,450 | B2 * | 8/2021 | Li | A24F 40/42 |
| 2008/0092912 | A1 * | 4/2008 | Robinson | A24D 1/20 131/200 |
| 2014/0202476 | A1 | 7/2014 | Egoyants et al. | |
| 2015/0189915 | A1 * | 7/2015 | Liu | A24F 40/42 131/329 |
| 2016/0324216 | A1 * | 11/2016 | Li | A61M 15/06 |
| 2018/0027882 | A1 | 2/2018 | Hepworth et al. | |
| 2018/0132535 | A1 | 5/2018 | Reevell | |
| 2018/0168230 | A1 | 6/2018 | Reevell | |
| 2018/0169355 | A1 | 6/2018 | Reevell | |
| 2018/0177233 | A1 * | 6/2018 | Tucker | A24F 40/40 |
| 2018/0255834 | A1 * | 9/2018 | Dillmann | A24B 15/167 |
| 2019/0230993 | A1 * | 8/2019 | Buchberger | A61M 15/0091 |
| 2020/0281257 | A1 | 9/2020 | Kim et al. | |

FOREIGN PATENT DOCUMENTS

| | | | |
|---|---|---|---|
| EP | 3 062 644 | B1 | 2/2020 |
| JP | 2018-512118 | A | 5/2018 |
| JP | 2018-516551 | A | 6/2018 |
| KR | 10-2013-0139298 | A | 12/2013 |
| KR | 10-2014-0068807 | A | 6/2014 |
| KR | 10-2016-0064159 | A | 6/2016 |
| WO | 2013/102609 | A2 | 7/2013 |
| WO | 2016/179376 | A1 | 11/2016 |
| WO | 2017/055584 | A1 | 4/2017 |
| WO | 2017/207586 | A1 | 12/2017 |

OTHER PUBLICATIONS

International Search Report for PCT/KR2019/011950 dated Dec. 26, 2019 [PCT/ISA/210].
Written Opinion for PCT/KR2019/011950 dated Dec. 26, 2019 [PCT/ISA/237].
Office Action dated Apr. 20, 2023, issued in Chinese Application No. 201980055740.6.
Office Action dated Jun. 7, 2022, issued in Japanese Application No. 2020-551837.

* cited by examiner

APPARATUS FOR GENERATING AEROSOLS COMPRISING HEATER FOR HEATING MATERIALS HAVING DIFFERENT PHASES FROM EACH OTHER

TECHNICAL FIELD

The present disclosure relates to an aerosol generating device including a heater for heating materials having different phases from each other.

BACKGROUND ART

Recently, the demand for alternative methods to overcome the shortcomings of general cigarettes has increased. For example, there is an increasing demand for a method of generating aerosol by heating an aerosol generating material in cigarettes, rather than by burning cigarettes. Accordingly, studies on a heating-type cigarette or a heating-type aerosol generating device have been actively conducted.

According to the related art, a device and method for generating aerosols by heating an aerosol generating material having a solid phase may provide a unique taste for cigarettes, but have limitations in providing a large amount of aerosol particles for inhalation. A device and method for generating aerosols by heating an aerosol generating material having a liquid phase may provide large quantities of aerosol particles for inhalation compared to a method for heating an aerosol generating material having a solid phase, but it is difficult to provide a unique taste for cigarettes.

Thus, a method for generating aerosols by heating aerosol generating materials having a solid phase and a liquid phase has also been devised. However, since aerosol generating materials having a solid phase and a liquid phase differ in characteristics such as heating temperature, the method and device for heating aerosol generating materials having a solid phase and a liquid phase have been implemented to include a plurality of heaters.

However, when two or more heaters are employed in one aerosol generating device, it may be difficult to downsize a device due to the volume of the heaters. In addition, in a process of arranging two or more heaters in the device, the design of an internal structure of the device may be complicated, and the operation of a controller for controlling heaters that operate at different temperatures may be complicated. When the number of heaters included in the device increases, the cost for commercializing the device may also increase.

A technique for heating an aerosol generating material having a solid or liquid phase with a single heater is required so that advantages of the above-described method of heating only an aerosol generating material having a solid or liquid phase may be employed and problems caused by the plurality of heaters included in the device may be solved.

DESCRIPTION OF EMBODIMENTS

Technical Problem

Provided is an aerosol generating device including a heater for heating materials having different phases from each other. The technical problems to be achieved by the present disclosure are not limited to the technical problems as described above, and other technical problems may be inferred from the following embodiments.

Solution to Problem

According to an aspect of the present disclosure, an aerosol generating device includes a heater for heating a first material having a solid phase and a second material having a liquid phase, and a controller for controlling power supplied to the heater, wherein, as the heater is powered, a first aerosol generated from the first material and a second aerosol generated from the second material may be released.

ADVANTAGEOUS EFFECTS OF DISCLOSURE

By using an aerosol generating device according to the present disclosure, a first aerosol may be generated from a first material, and a second aerosol may be generated from a second material so that the first aerosol and the second aerosol may be simultaneously provided to a user.

The first aerosol generated from the first material having a solid phase may provide a unique taste for cigarettes to a user, and the second aerosol generated from the second material having a liquid phase may provide a large amount of aerosol particles for inhalation by the user, so that an aerosol generating device having an enhanced structure may be implemented.

Furthermore, as the aerosol generating device according to the present disclosure employs only a single heater for heating the first material having the solid phase and the second material having the liquid phase, costs for manufacturing the aerosol generating device may be reduced, and the aerosol generating device may be slimmed down.

BEST MODE

An aerosol generating device according to one aspect of the present disclosure, includes a heater for heating a first material having a solid phase and a second material having a liquid phase; and a controller for controlling power supplied to the heater, wherein, as the heater is powered, a first aerosol generated from the first material and a second aerosol generated from the second material may be released.

MODE OF DISCLOSURE

Hereinafter, exemplary embodiments will be described in detail with reference to the accompanying drawings. The following description is only for the purpose of embodying the embodiments and does not limit or restrict the scope of rights of the disclosure. From the detailed description and examples, what can be easily inferred by experts in the art is interpreted as belonging to the scope of rights.

As used herein, terms such as "consist of" or "comprise" are not to be interpreted as including all of various elements or various steps described in the specification, and it should be interpreted that the terms such as "consist of" or "comprise" may not include some of them or some steps or may further include additional elements or steps.

The present embodiments relate to an aerosol generating device including a heater for heating materials having different phases from each other, and detailed descriptions of matters well known to those of ordinary skill in the art to which the following embodiments belong, will be omitted.

Figure 1:
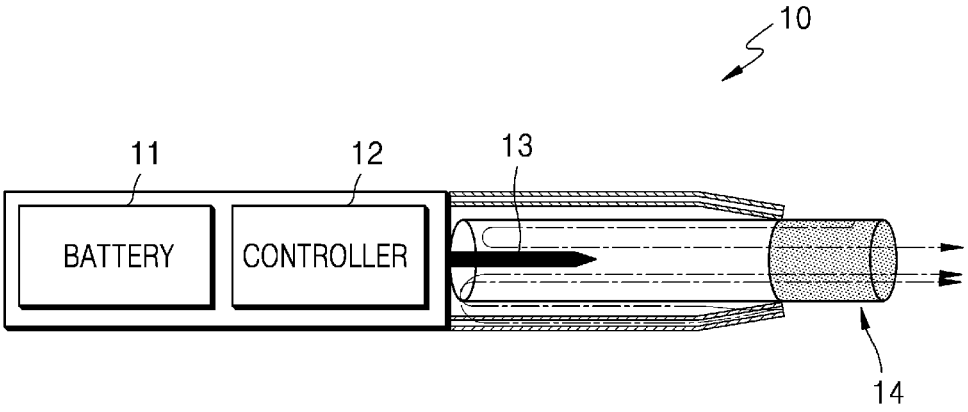
FIG. 1 is a view illustrating an aerosol generating device in which an aerosol generating material having a solid phase is heated, according to the related art.

FIG. 1 is a view illustrating an aerosol generating device in which an aerosol generating material having a solid phase is heated, according to the related art.

Referring to FIG. 1, a device 10 for generating aerosols according to the related art may include a battery 11, a controller 12, and a heater 13. A cigarette 14 may be inserted into the device 10. As an aerosol generating material having a solid phase included in the cigarette 14 is heated by the heater 13, aerosols may be generated.

Like in a combustive cigarette according to the related art, the device 10 may heat an aerosol generating material having a solid phase to generate aerosols, thereby providing a unique taste for cigarettes.

However, compared to a method of heating an aerosol generating material having a liquid phase, which will be described later, the device may have a problem that it does not release a large amount of aerosol particles for smoking.

Figure 2:
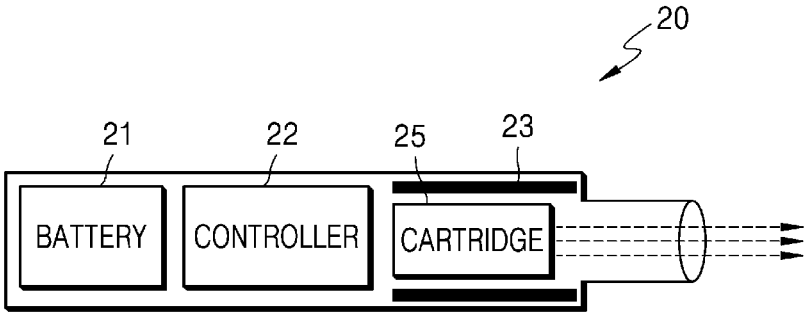
FIG. 2 is a view illustrating an aerosol generating device in which an aerosol generating material having a liquid phase is heated, according to the related art.

FIG. 2 is a view illustrating an aerosol generating device in which an aerosol generating material having a liquid phase is heated, according to the related art.

Referring to FIG. 2, an device 20 for generating aerosols according to the related art may include a battery 21, a controller 22, and a heater 23. The device 20 may further include a cartridge 25.

The cartridge 25 may accommodate an aerosol generating material having a liquid phase. The cartridge 25 is detachable from the device 20 and may be replaced, or the aerosol generating material having the liquid phase may be additionally injected into the cartridge 25.

Unlike in the combustive cigarette according to the related art, since the device 20 heats the aerosol generating material having the liquid phase by using the heater 23 to generate aerosols, the device may have a problem that it does not easily provide a unique of taste for cigarettes.

However, since the device 20 generates aerosols by evaporating the aerosol generating material having the liquid phase rather than burning or heating the aerosol generating material having the solid phase, the device 20 may have the advantage of being capable of providing a large amount of aerosol particles for inhalation by a user.

According to the present disclosure, a heater and an aerosol generating device, which provide a unique taste for cigarettes and release a large amount of aerosols for inhalation by employing the advantages of the device 10 for heating the aerosol generating material having the solid phase and the device 20 for heating the aerosol generating material having the liquid phase and which may simultaneously heat the aerosol generating material having the solid phase and the aerosol generating material having the liquid phase, may be provided.

Figure 3:
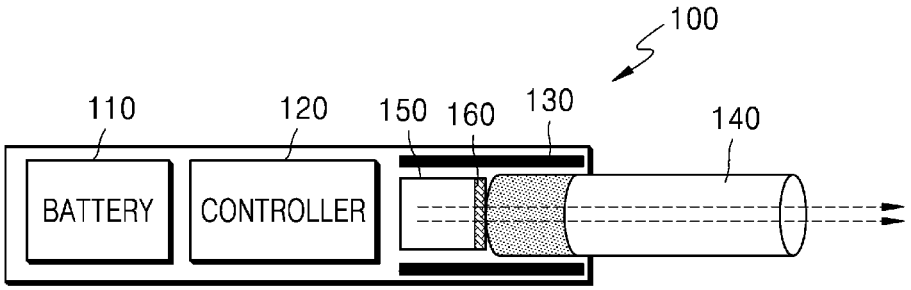
FIG. 3 is a view illustrating an aerosol generating device including a heater for heating aerosol generating materials having two phases according to an embodiment.

FIG. 3 is a view illustrating an aerosol generating device including a heater for heating aerosol generating materials having two phases according to an embodiment.

Referring to FIG. 3, a device 100 for generating aerosols according to the present disclosure may include a battery 110, a controller 120, and a heater 130. It may be understood by those of ordinary skill in the art related to the present embodiment that other general-purpose components may be further included in the device 100 in addition to the components illustrated in FIG. 3.

The battery 110 may supply electric power to the controller 120 and the heater 130. The battery 110 may supply electric power to the heater 130 by supplying a current pulse to the heater 130.

The controller 120 may control various operations to be performed within the device 100. For example, the controller 120 may control the current pulse supplied to the heater 130 by the battery 110 so that the heater 130 may be heated.

The heater 130 may heat a first material having a solid phase and a second material having a liquid phase. The heater 130 may be located outside the first material and the second material within the device 100. As the heater 130 is powered from the battery 110, the heater 130 may heat the first material having the solid phase and the second material having the liquid phase.

However, embodiments are not limited thereto, and the heater 130 may also be located inside the first material and the second material to heat the first material and the second material. Furthermore, the heater 130 may be located outside any one of the first material and the second material and inside the other one of the first material and the second material to heat the first material and the second material.

The heater 130 may be provided in a single number to heat the first material and the second material. Thus, two or more heaters may not be included in the device 100 so as to heat the first material and the second material. Since the heater for heating the first material and the heater for heating the second material are the same heater 130, the internal structure of the device 100 and operation control of the device 100 may be more simplified.

As the heater 130 is powered from the battery 110, a first aerosol may be generated from the first material, and a second aerosol may be generated from the second material. The generated first aerosol and second aerosol may be released from the device 100 and provided to the user.

As the heater 130 heats the first material and the second material and the device 100 generates the first aerosol and the second aerosol to provide the generated first aerosol and second aerosol to the user, thereby providing a unique taste for cigarettes and providing a large amount of aerosol particles for inhalation. In detail, the device 100 may provide the first aerosol generated from the first material, thereby providing a unique taste for cigarettes and may provide the second material generated from the second material, thereby providing a large amount of aerosol particles for inhalation.

The device 100 may further include a passage portion 160 formed to have a porous structure. As the second material is heated by the heater 130, the generated second aerosol may be released through the passage portion 160. For example, the passage portion 160 may be located between a position where the second aerosol is generated, and a position where the second aerosol is released, within the device 100. Alternatively, the passage portion 160 may also be included in a container for accommodating the second material.

The heater 130 may heat the first material and the second material at different temperatures. The temperature suitable for generating the first aerosol from the first material and the temperature suitable for generating the second aerosol from the second material may be different from each other. Thus, the heater 130 may be implemented to heat the first material and the second material at different temperatures.

For example, the heater 130 may include a first portion for heating the first material and a second portion for heating the second material. When the electrical resistances of the first portion and the second portion are different from each other, even when the same current pulse is supplied to the first portion and the second portion, the first portion and the second portion may transmit different power.

The device 100 may generate the first aerosol and the second aerosol, and an aerosol in which the first aerosol and the second aerosol are mixed with each other, may be released from the device 100. The first aerosol and the second aerosol may be generated in the same amount, mixed with each other and released from the device 100.

However, embodiments are not limited thereto, and the composition ratios of the first aerosol and the second aerosol within the mixed aerosol may be different from each other. For example, the ratio in which the first aerosol and the second aerosol are generated, may be suitably employed in the range of 0:10 to 10:0. The first aerosol and the second aerosol generated according to the above-described ratios may be mixed with each other and released from the device 100.

The device 100 may further include a first container 140 for accommodating the first material having the solid phase and a second container 150 for accommodating the second material having the liquid phase. Referring to the example shown in FIG. 3, the first container 140 and the second container 150 may be arranged in a row and heated by the heater 130. However, embodiments are not limited thereto, and the first container 140 and the second container 150 may be arranged in any position in which the heater 130 may heat the first container 140 and the second heater 150, within the device 100.

The first material may be included in the cigarette inserted in the device 100, and the second material may be included in the cartridge coupled to the device 100. For example, as the cigarette containing a tobacco material having a solid phase is inserted in the device 100 and the cartridge containing an aerosol generating material having a liquid phase is coupled to the device 100, the device 100 may generate aerosols from the tobacco material having the solid phase and the aerosol generating material having the liquid phase, respectively.

The cartridge may be implemented with a liquid tank for accommodating the second material having the liquid phase. Alternatively, the cartridge may include a porous material so that the second material having the liquid phase may be immersed in the porous material inside the cartridge. Meanwhile, the cartridge may be of a charging type in which the second material may be injected, and the cartridge itself may be of a replacement type in which it is detachable from the device 100.

As described above, the cigarette is illustrated as an example of the first container, and the cartridge is illustrated as an example of the second container. However, embodiments are not limited thereto, and the first container may be another article for accommodating the first material having the solid phase, and the second container may be another container for accommodating the second material having the liquid phase.

The heater 130 may be located on at least a portion of the side surface of the first container and at least a portion of the side surface of the second container. Referring to the example shown in FIG. 3, the heater 130 may be located to surround the side surfaces of the first container 140 and the second container 150, which are arranged in a row. Alternatively, the heater 130 may be arranged in only a portion of a circumferential direction of at least one of the first container 140 and the second container 150 or only a portion of a longitudinal direction thereof.

The heater 130 may extend up to at least a portion of the bottom surface of the second container. Referring to the example shown in FIG. 3, the heater 130 may be arranged to surround the side surfaces of the first container 140 and the second container 150, which are arranged in a row, and may also extend up to at least a portion of the bottom surface toward the controller 120 of the second container 150. As the heater 130 extends up to at least a portion of the bottom surface of the second container, generation of the second aerosol may be further promoted.

In the above-described portion and a portion to be described later in the present specification, the first material accommodated in the first container 140 is a material having a solid phase, and the second material accommodated in the second container 150 is a material having a liquid phase. However, this is just for conveniences of explanations, and it may be understood by those of ordinary skill in the art related to the present embodiment that the first material may be implemented with a material having a liquid phase and the second material may be implemented with a material having a solid phase.

Figure 4:
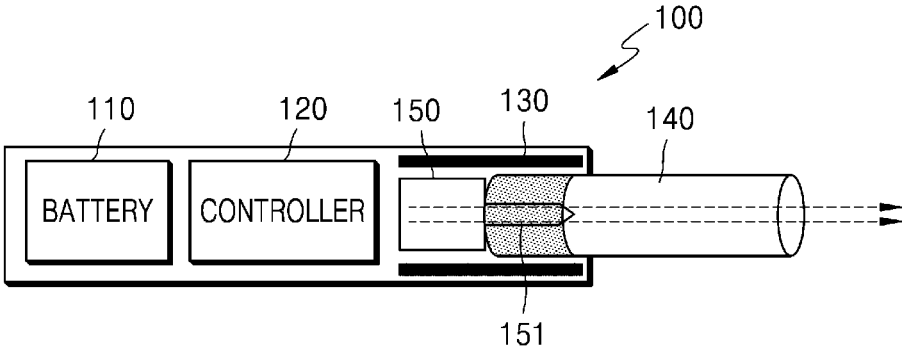
FIG. 4 is a view illustrating an aerosol generating device further including a first container and a second container, according to an embodiment.

FIG. 4 is a view illustrating an aerosol generating device further including a first container and a second container according to an embodiment.

Referring to FIG. 4, the device 100 may further include a first container 140 and a second container 150 in addition to the battery 110, the controller 120, and the heater 130, and the second container 150 may include a protrusion part 151 inserted into the first container 140.

The protrusion part 151 inserted into the first container 140 may be inserted into the first material having the solid phase accommodated in the first container 140. In a state in which the protrusion part 151 is inserted into the first material, the heater 130 may heat the first material and the second material, and a first aerosol and a second aerosol may be generated.

The protrusion part 151 may include a heat conductive material for transferring heat generated by the heater 130. When the heater 130 heats the second material accommodated in the second container 150, the heat conductive material may also be heated together, and the heat conductive material may transfer heat transmitted from the heater 130 to the first material accommodated in the first container 140.

The protrusion part 151 may include the heat conductive material, thereby conducting heat from the heater 130 and heating the first material. Thus, the protrusion part 151 may perform a role corresponding to the heater 130 by heating at least one of the first material and the second material, separately from the heater 130.

The heat conductive material may be a metal material that is located on the surface of the protrusion part 151 and connected to the heater 130 along the second container 150. For example, the heat conductive material may be stainless steel, tungsten, gold, platinum, silver, copper, nickel, chromium, palladium, or a combination thereof. Also, the heat conductive material may be doped by an appropriate dopant and may include an alloy. However, embodiments are not limited thereto, and the heat conductive material may be a material having high heat conductivity and capable of transferring heat generated from the heater 130 to the first material through heat conduction.

The first aerosol may be generated as the first material is heated by at least one of the heater 130 and the protrusion part 151. Referring to the example shown in FIG. 4, the first material accommodated in the first container 140 may be heated by the heater 130 and the protrusion part 151. However, the first material may also be heated by only the protrusion part 151. In this case, the heater 130 may be arranged to heat only the second container 150, unlike in FIG. 4.

The protrusion part 151 may serve as an internal heating heater inserted into the first container 140, and the heater 130 may selectively serve as an external heating heater for heating the first container 140 outside. As the device 100 may heat the first material even inside in addition to the outside, the efficiency of generating the first aerosol may be enhanced.

Figure 5:
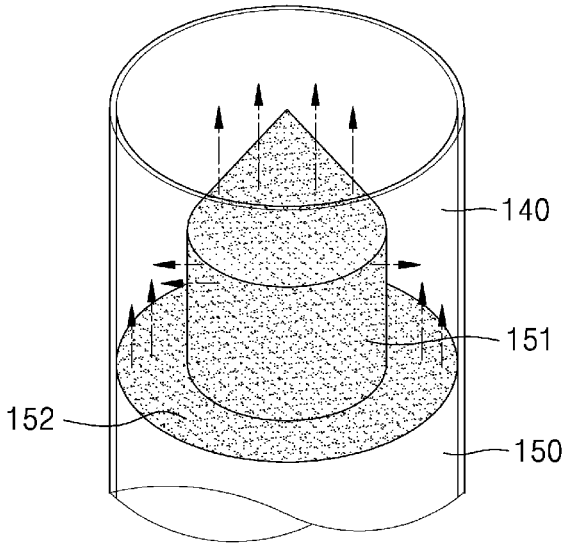
FIG. 5 is a view illustrating a porous structure formed in at least a portion of the second container, according to an embodiment.

FIG. 5 is a view illustrating a porous structure formed in at least a portion of the second container according to an embodiment.

Referring to FIG. 5, the first container 140 may be coupled to the second container through the protrusion part 151. At least a portion of the second container may be formed to have a porous structure 152. In the example of FIG. 5, the whole of the protrusion part 151 and the entire top surface of the second container 150 are formed to have the porous structure 152. However, only a portion of the protrusion part 151 that is at least a portion of the second container may be formed to have the porous structure 152, and only a portion of the top surface of the second container 150 may also be formed to have the porous structure 152.

The second aerosol may be released through the porous structure 152. When the second material accommodated in the second container 150 is heated by the heater 130 and the second aerosol is generated, the second aerosol may be delivered to the first container 140 through the porous structure 152 formed in at least a portion of the second container and may be released to the outside of the device 100.

As described above, when the protrusion part 151 includes the heat conductive material and serves as an internal heating heater inserted into the first container 140, the protrusion part 151 may operate as a heater having the porous structure 152 for emitting the second aerosol.

Figure 6:
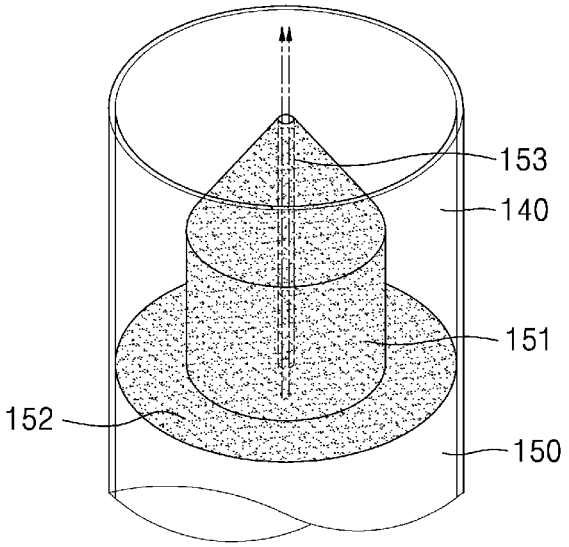
FIG. 6 is a view illustrating a hollow passing through the inside of the first container and the inside of the second container, according to an embodiment.

FIG. 6 is a view illustrating a hollow passing through the inside of the first container and the inside of the second container according to an embodiment.

Referring to FIG. 6, the second container 150 may further include a hollow 153. The hollow 153 may be located along the protrusion part 151 and may communicate with the first container 140 and the second container 150. An end of the first container 140 of the hollow 153 may be located in a position in which the first material is not accommodated. For example, the first material accommodated in the first container 140 may be located at the bottom of the first container 140 so as to be in contact with the protrusion part 151 but may not be located near the end of the first container 140 of the hollow 153.

As described above, as the hollow 153 is arranged so that the first material may not be located near the end of the first container 40 of the hollow 153, part of the second aerosol may pass through the first material through the porous structure 152 and may be released, and the remaining part of the second aerosol may be released through the hollow 153 without passing through the first material. Part of the second aerosol generated from the second material accommodated in the second container 150 may be released through the porous structure 152, and the remaining part thereof may be released through the hollow 153.

Since the porous structure 152 formed in at least a portion of the second container 150 is in contact with the first material accommodated in the first container 150, part of the second aerosol released through the porous structure 152 may pass through the first material and be released to the outside of the device 100. While part of the second aerosol passes through the first material and is released, an aerosol having a different flavor or taste from that of the first aerosol or the second aerosol may be released.

In the hollow 153 included in the second container 150, the end of the first container 150 does not contact the first material, so that the remaining part of the second aerosol released through the hollow 153 may be released to the outside the device 100 without passing through the first material. Since the remaining part of the second aerosol does not pass through the first material, the intended flavor or taste of the second aerosol may be released to the outside of the device 100 without the effect of the first material.

The composition ratios of a part and the remaining part of the second aerosol may be different from each other. At least one of the distribution of the porous structure 152 and the diameter of the hollow 153 is adjusted, the composition ratios of a part and the remaining part of the second aerosol may be changed.

Figure 7:
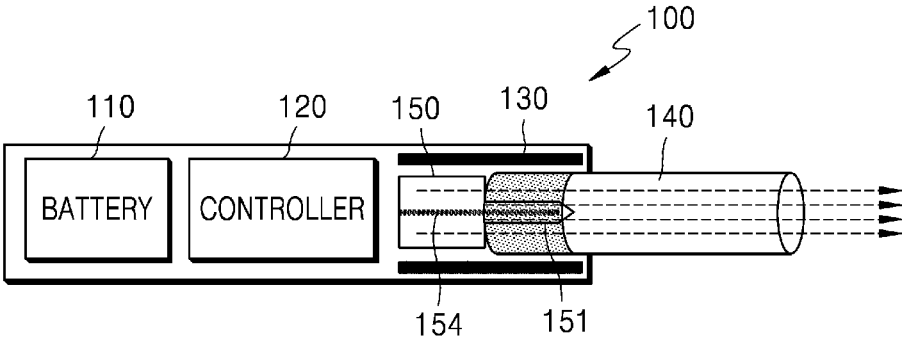
FIG. 7 is a view illustrating an aerosol generating device in which a second container further includes a wick, according to an embodiment.

FIG. 7 is a view illustrating an aerosol generating device, wherein a second container further includes a wick, according to an embodiment.

Referring to FIG. 7, the second container 150 may further include a wick 154 that is arranged along the hollow 153 and delivers the second material to the protrusion part 151. The wick 154 may be located from the end of the first container 140 of the hollow 153 to the inside of the second container 150.

The wick 154 may include at least one of cotton fiber, ceramic fiber, glass fiber, and porous ceramic, and may deliver the second material from the inside of the second container 150 to the protrusion part 151 according to a capillary phenomenon. However, the wick 154 is just employed as an example of a liquid delivery element, and it may be understood by those of ordinary skill in the art related to the present embodiment that the wick 154 may be modified into another element for delivering the second material and implemented.

The second aerosol may be generated as the second material is heated by at least one of the heater 130 and the protrusion part 151. Referring to the example shown in FIG. 7, the second material accommodated in the second container 150 may be heated by the heater 130 so that a second aerosol may be generated.

Furthermore, the protrusion part 151 may include a heat conductive material, thereby heating the wick 154 through heat conducted from the heater 130. Thus, the second material delivered from the inside of the second container 150 to the protrusion part 151 along the wick 154 may be heated by the protrusion part 151 so that a second aerosol may also be generated.

As the second container 150 further includes the wick 154, the second aerosol may be generated as the second material inside the second container 150 is heated by the heater 130, and the second material may be delivered to the protrusion part 151 along the wick 154 and may also be generated by being heated by the protrusion part 151. Thus, the efficiency of generating the second aerosol may be further enhanced.

Since, as described above, at least a portion of the second container 150 may be formed to have the porous structure 151, part of the second aerosol may pass through the first material through the porous structure 152 and may be released, and the remaining part of the second aerosol may be released through the hollow 153 without passing through the first material. Since the wick 154 that delivers the second material to generate a second aerosol is arranged along the hollow 153, the remaining part of the second aerosol may be released through the hollow 153.

Furthermore, as described above, while the second aerosol passes through the first material, an aerosol having a different flavor or taste from that of the second aerosol may be released, and the second aerosol that is not affected by the first material may also be released.

Figure 8:
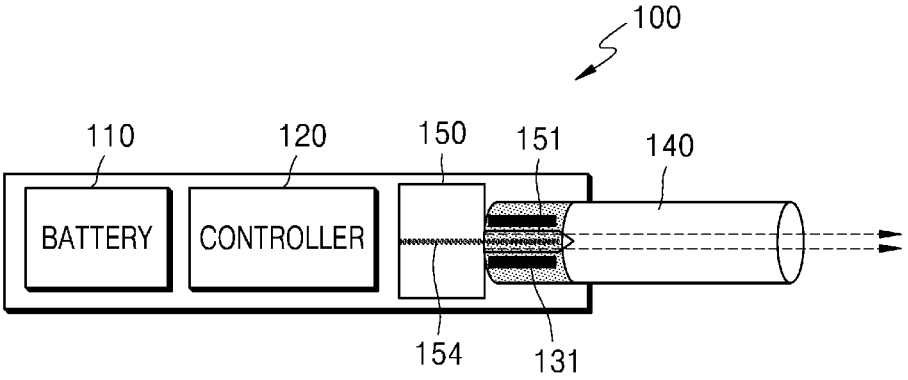
FIG. 8 is a view illustrating an aerosol generating device including a heater arranged outside a protrusion part included in a second container according to an embodiment.

FIG. 8 is a view illustrating an aerosol generating device including a heater arranged outside a protrusion part included in the second container, according to an embodiment.

Referring to FIG. 8, the device 100 may include a heater 131 instead of the heater 130. The heater 131 may be arranged outside the protrusion part 151. The heater 131 may be inserted into the first container 140 together with the protrusion part 151. In detail, the heater 131 may be inserted into the first container 140 and may be in contact with the first material accommodated in the first container 140.

The heater 131 may be inserted into the first container 140 and may heat the first material using an internal heating heater. When the heater 131 is arranged outside the protrusion part 151, the protrusion part 151 may not include a heat conductive material, and the heater 131 instead of the protrusion part 151 may heat the first material.

Since the heater 131 is inserted into the first container 140 and is in direct contact with the first material to heat the first material, the efficiency of generating a first aerosol may be enhanced compared to a method in which the heater 130 located outside the first container 140 heats the first material from outside.

As described above, the second container 150 may further include the hollow 153 and the wick 154. The wick 154 may be arranged along the hollow 153 and may deliver the second material so that the second material may be heated.

As the second material delivered to the protrusion part 151 by the wick 154 is heated by the heater 131, the second aerosol may be generated and released through the hollow 153.

Comparing the examples shown in FIGS. 7 and 8, compared to the case where the second material delivered to the protrusion part 151 by the wick 154 is heated by heat conduction of the protrusion part 151, as shown in FIG. 7, in FIG. 8, the second material delivered to the protrusion part 151 by the wick 154 may be heated by the heater 131, so that the efficiency of generating the second aerosol may be enhanced.

Although the embodiments have been described in detail above, the scope of rights of the present disclosure is not limited thereto, and various modifications and improvements of those skilled in the art using the basic concept of the present disclosure defined in the following claims also belong to the scope of rights of the present disclosure.

The invention claimed is:

1. An aerosol generating device comprising:

a heater for heating a first material having a solid phase and a second material having a liquid phase; and a controller for controlling power supplied to the heater;

a first container for accommodating the first material and a second container for accommodating the second material;

wherein, as the heater is powered, a first aerosol generated from the first material and a second aerosol generated from the second material are released, and wherein the second container comprises a protrusion part inserted into the first container and comprising a heat conductive material for delivering heat generated by the heater.

2. The device of claim 1, further comprising a passage portion formed to have a porous structure, wherein the second aerosol is released through the passage portion.

3. The device of claim 1, wherein the first aerosol is generated as the first material is heated by at least one of the heater and the protrusion part.

4. The device of claim 3, wherein at least a portion of the second container is formed to have a porous structure, and the second aerosol is released through the porous structure.

5. The device of claim 4, wherein the second container further comprises a hollow, the hollow is arranged along the protrusion part and connected to an inside of the first container and an inside of the second container, part of the second aerosol is released by passing through the first material through the porous structure, and a remaining part of the second aerosol is released through the hollow without passing through the first material.

6. The device of claim 3, wherein the second container further comprises a hollow and a wick that is arranged along the hollow and delivers the second material to the protrusion part, the hollow is arranged along the protrusion part and is connected to the inside of the first container and the inside of the second container, and the second aerosol is generated as the second material is heated by at least one of the heater and the protrusion part.

7. The device of claim 6, wherein at least a portion of the second container is formed to have a porous structure, and part of the second aerosol passes through the first material through the porous structure and is released, and a remaining part of the second aerosol is released through the hollow without passing through the first material.

8. The device of claim 1, wherein the heater is arranged on at least a portion of a side of a first container for accommodating the first material and on at least a portion of a side of the second container for accommodating a second material.

9. The device of claim 8, wherein the heater extends to at least a portion of a bottom surface of the second container.

10. The device of claim 1, wherein the heater is arranged outside the protrusion part.

11. The device of claim 10, wherein the second container further comprises a hollow and a wick that is arranged along the hollow and delivers the second material to the protrusion part, the hollow is arranged along the protrusion part and connected to the inside of the first container and the inside of the second container, and as the second material delivered to the protrusion part by the wick is heated by the heater, the second aerosol is generated and is released through the hollow.

12. The device of claim 1, wherein the heater heats the first material and the second material at different temperatures.

13. The device of claim 1, wherein an aerosol in which the first aerosol and the second aerosol are mixed with each other, is released, and composition ratios of the first aerosol and the second aerosol in the mixed aerosol are different from each other.

14. The device of claim 1, wherein the first material is included in a cigarette inserted into the device, and the second material is included in a cartridge coupled to the device.

* * * * *